United States Patent [19]

Runyon

[11] 4,212,223

[45] Jul. 15, 1980

[54] MOUTHPIECE FOR WOODWIND MUSICAL INSTRUMENTS

[76] Inventor: Clinton A. Runyon, P.O. Box 1018, Opelousas, La. 70570

[21] Appl. No.: 955,172

[22] Filed: Oct. 27, 1978

[51] Int. Cl.[2] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 1,583,382 | 5/1926 | Bauer | 84/383 R |
| 2,397,593 | 4/1946 | Brilhart | 84/383 R |
| 4,041,827 | 8/1977 | Daglis | 84/383 R |

FOREIGN PATENT DOCUMENTS

| | | | |
|---|---|---|---|
| 934371 | 1/1948 | France | 84/383 R |

*Primary Examiner*—Lawrence R. Franklin

*Attorney, Agent, or Firm*—Clarence A. O'Brien; Harvey B. Jacobson

[57] ABSTRACT

A mouthpiece is disclosed which has an internal sympathetic reed for use with single reed woodwind musical instruments, such as saxophones, clarinets, and the like. With the mouthpiece of the present invention, a tone is produced which is altered to suit particular needs of musical composers. An altered tone which is brighter and livelier is produced, rather than the more subdued altered tones, which are commonly produced with mutes of various types for use with various instruments. Accordingly, with the present invention, a wide range of tone qualities is possible to expand the range of artistic effects obtainable with common reed-type musical instruments.

4 Claims, 5 Drawing Figures

MOUTHPIECE FOR WOODWIND MUSICAL INSTRUMENTS

BACKGROUND OF THE INVENTION

1. Field of the Invention

The invention relates to an improvement in woodwind musical instrument mouthpieces to enable an altered tone quality to be produced. More particularly, the invention contemplates a modification of the mouthpiece for single reed instruments, such as clarinets and saxophones, wherein an independently mounted secondary reed is placed inside the hollow mouthpiece chamber, the secondary reed vibrating sympathetically when the primary reed is placed in vibrating motion during ordinary use of the instrument to which the mouthpiece is attached.

2. Description of the Prior Art

Acoustical principles underlying sympathetic vibrations or sympathetic resonance are disclosed in the volume Sensations of Tone, H.L.F. Helmholtz, Longmans, Green Company, London (1885), as well as the acoustical theory underlying certain reed instruments, such as the clarinet.

A mouthpiece for a reed instrument is disclosed in U.S. Pat. No. 1,583,382, issued May 4, 1926, to Bauer, where a single piece of stamped bifurcated metal is secured to the inside surface of the mouthpiece, where functioning depends on a critical position in the mouthpiece of the inserted piece of metal in order to accomplish its purpose. DeLuca in U.S. Pat. No. 2,530,155, issued Nov. 14, 1950, discloses a musical instrument mouthpiece for varying the tonal qualities by the musician, and Brilhart in U.S. Pat. No. 2,397,593, issued Apr. 2, 1946, describes a musical instrument mouthpiece having a tone-modifying member inserted within the tone chamber of the mouthpiece. Strathmann in U.S. Pat. No. 3,202,032, issued Aug. 24, 1965, also discloses a musical instrument mouthpiece with a wedge-shaped member slidably adjusted lengthwise of the mouthpiece bore parallel to the inclined upper wall of a conventional mouthpiece. None of these patents contains a disclosure of a secondary reed suspended in the instrument mouthpiece tone chamber substantially parallel to the primary reed, nor is there a disclosure of a device inside the tone chamber set in motion sympathetically by vibrations of the primary reed. Other related patents include the following:

U.S. Pat. Nos: 2,224,719—Dec. 10, 1940—Brilhart 2,499,855—Mar. 7, 1950—Gamble 3,029,554—Apr. 17, 1962—Mobley 3,579,903—May 25, 1971—Stewart 3,791,253—Feb. 12, 1974—Pascucci et al.

SUMMARY OF THE INVENTION

The invention provides a woodwind musical instrument mouthpiece in the interior of which is mounted a secondary reed which vibrates inside the tone chamber of the mouthpiece for the purpose of adding intensity and character to the tone quality when the mouthpiece is played with an associated appropriate musical instrument. The instruments which are particularly contemplated for modification according to the teachings of the present invention include but are not limited to various types of clarinet and saxophone, comprising clarinets, such as a B-flat clarinet, an alto clarinet, a bass clarinet, and the like; also contemplated are saxophones of various construction, including alto saxophones, tenor saxophones, baritone saxophones, soprano saxophones, and bass saxophones. The secondary reed is preferably mounted in a plane parallel to the plane of the chink formed between the primary reed and the end of the mouthpiece frame through which the musical performer blows. It is, however, possible to alter the nature of the modified tone or sound of an instrument provided with the mouthpiece of the present invention by bending the secondary reed closer to the primary reed, thereby producing a louder and brighter tone, or by bending the secondary reed away from the primary reed in order to make a darker sound.

Accordingly, it is an object of the present invention to provide a mouthpiece for instruments having an elastic primary reed, where the mouthpiece is provided with a secondary reed mounted inside the mouthpiece for vibrating sympathetically when the mouthpiece is used by a musical performer in association with a suitable reed musical instrument body, such as that of a clarinet or saxophone.

Another object of the invention is to provide a secondary reed vibrating sympathetically within the tone chamber of a musical instrument mouthpiece where the secondary reed can be mounted to the mouthpiece frame by a suitable adhesive.

Still another object of the invention is to provide a secondary reed integral with the frame of the mouthpiece.

A further object of the invention is to provide a secondary reed which can be positioned so as to alter the quality of tone produced by bending the secondary reed near its point of attachment to the mouthpiece frame.

Yet a further object of the invention is to provide a secondary reed which, when bent closer to the primary reed, produces a louder and brighter tone, and, conversely, when bent away from the primary reed makes a darker sound.

Still a further object of the invention is to provide a secondary reed vibrating sympathetically with a primary reed inside the mouthpiece, where the secondary reed is made from brass.

Yet a still further object of the invention is to provide a secondary reed inside a musical instrument mouthpiece for the purpose of adding extra intensity and character to the tone quality produced by the instrument.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
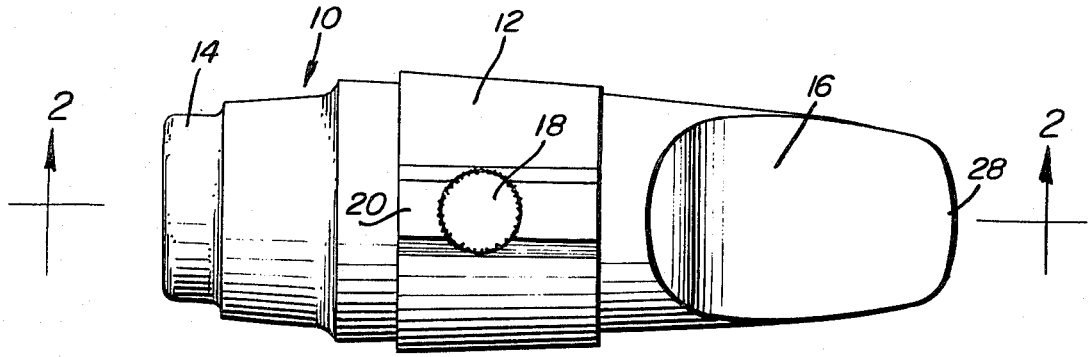
FIG. 1 is a top plan view of a mouthpiece for use with an alto saxophone, where a ligature to hold a cane reed is shown tightened in place. Neither the primary reed nor the secondary reed is visible in the view shown in FIG. 1.
Figure 4:
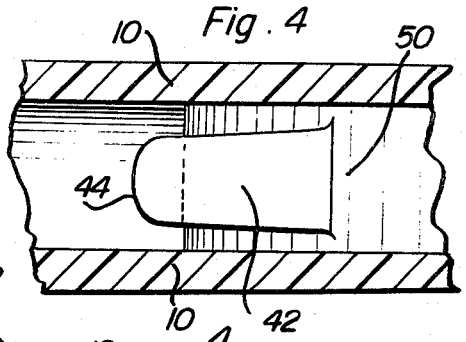
FIG. 4 is a fragmentary longitudinal sectional view of the device of FIG. 2, taken substantially upon a plane passing along section line 4—4 in FIG. 2.

The mouthpiece for single reed instruments is conventionally carved from wood or plastic, or, if made from plastic, can be made by conventional lost wax casting or molding techniques in the same manner as dentures. Although varying somewhat in size, external appearance, and shape, according to the intended instruments with which the mouthpiece is to be used, the general configuration and structure of mouthpieces to be used with various single reed musical instruments is as shown in FIG. 1, where a mouthpiece frame 10 is illustrated, over which tapered annular ligature 12 slides in order to retain the primary reed in contact with the lower surface of mouthpiece 10. Mouthpiece frame 10 is made up of tubular connection 14 for insertion within the upper end of a conventional alto saxophone instrument body (not shown), and frame 10 also has inclined wall 16 against which the musical performer's upper lip rests during operation of the instrument. Threaded thumb screw 18 passes through a compatibly threaded through hole in upraised platform 20 of ligature 12, with rotation of thumb screw 18 effecting tightening action of ligature 12 against the lower surface of mouthpiece frame 10 to hold the primary reed in place. The construction and operation of the ligature is standard and conventional and does not relate to operation or mounting of the secondary reed of the present invention.

Figure 2:
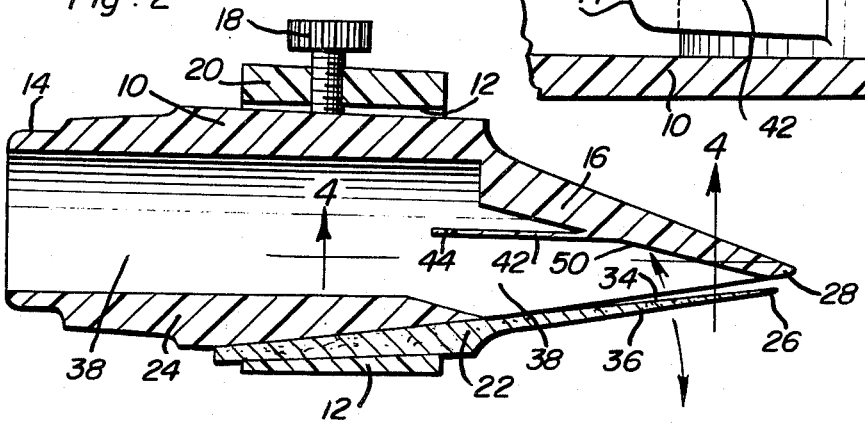
FIG. 2 is a longitudinal sectional view of the mouthpiece of FIG. 1, showing a secondary reed of integral construction with the mouthpiece frame.
Figure 3:
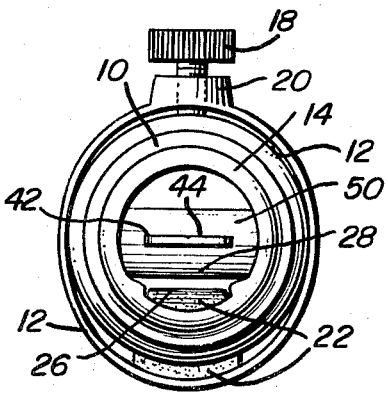
FIG. 3 is an end elevational view of the mouthpiece of FIG. 2, viewed longitudinally from the open end.

Referring now to FIG. 2, primary reed 22 can be seen held in place against base 24 of mouthpiece frame 10 by ligature 12. Primary reed 22 is conventionally cut out of elastic reed plates, such as cane, and tapers to primary reed edge 26, which projects somewhat below arcuate end 28 of inclined wall 50 of mouthpiece frame 10, leaving a chink through which the musician blows in order to set tapered edge 26 in vibratory motion in conventional operation of the instrument. The excursions of primary reed 22 in the direction indicated by the arcuate arrows in FIG. 2 are small, and the pressure of the lips brings edge 26 just near enough to make chink sufficiently small without allowing edge 26 to strike end 28. Vibrations of primary reed 22 set the entire column of air in the instrument in motion, and reinforcement from waves of air which arise in the interior of the instrument produces as alternation in the pressure of air adjacent to reed 22 sufficiently powerful to make it vibrate sensibly. The tones produced by the instrument has a pitch determined by the length of the column of air in the instrument, the acoustic length of which can be altered by opening the side holes located in the body (not shown) of the instrument. The time of vibration of primary reed 22 consists of the time of forward motion, the time of rest, and the time of recoil. When the reed is placed in the mouth, the air pressure on inside surface 34 of reed 22 is equal to the pressure adjacent outside surface 36 of reed 22. As the musician blows through chink, a suction is created against inside surface 34, drawing edge 26 in the direction of end 28 after the pulse of compressed air exits at the first found point of outlet on the musical instrument, external air then rushes in to restore equilibrium and cause edge 26 of reed 22 to recoil. Cyclic repetition of this process sets the entire column of air within mouthpiece frame 10 and the associated instrument body (not shown) in periodic motion which generates the acoustic tone or sound characteristic of the musical instrument. Accordingly, the air within mouthpiece tone chamber 38 oscillates to form a wave characteristic of the musical instrument with its side holes opened as desired by the musician to generate the desired tone. It is this oscillatory motion of the air within tone chamber 38 which sets secondary reed 42 into sympathetic vibration and causes a modification in the tone quality obtained.

The phenomenon of sympathetic resonance is well-known to musicians. When, for example, the strings of two violins are tuned to the same pitch, and one string is bowed, the other will begin to vibrate. Even when the pitch of the primary sounding body is not exactly that of the sympathetically vibrating body, the latter will nevertheless often make sensible sympathetic vibrations, which diminish in amplitude as the difference of pitch increases. Light elastic bodies which offer little resistance can be more easily adapted to vibrate sympathetically to a primary tone than massive elastic bodies. Moreover, sympathetic vibration can also be induced corresponding to the harmonic upper partial tones of the primary body. The mode of transmission from a primary vibrating body to a secondary vibrating body is well-known in the theory of sound, involving principles of wave motion observable in response to periodic changes in air pressure created by mechanical motion. Accordingly, when primary reed 22 begins to vibrate by excursions of edge 26 alternately toward and away from end 28 of mouthpiece frame 10, thereby setting in oscillatory motion the air in tone chamber 28 and producing the characteristic combination of proper and harmonic tones which are unique to the particular instrument with which the mouthpiece is associated, sympathetic reed 42 begins to vibrate through the action of the oscillatory motion of the air in tone chamber 38, with end 44 of secondary reed 42 describing vibratory motion in a direction essentially perpendicular to its plane. The unexpected finding embodied by the present invention is that with use of the secondary reed 42 inserted in tone chamber 38, the tone quality of the instrument is altered in that greater intensity and character of the tone quality results. Aesthetically speaking, use of the invention adds another dimension to the tone and adds life to the tone. With use of the present invention, not only is the quality of the musical experience enhanced, but the musician is capable of achieving a wider variety of artistic effects, in somewhat the same manner as a musician playing a trumpet or trombone with added a mute or a musician playing a violin or viola when modifying the tone quality with an appropriate muting device. Unlike the various known muting devices, however, the present invention does not shade the tone quality toward a more subdued or more mellow character, but instead achieves the opposite tone modification, by adding extra intensity, character and life without detracting therefrom.

Secondary reed 42 can be constructed of the same material as mouthpiece frame 10 and made integral with mouthpiece frame 10 as shown in FIG. 2. Mouthpiece 10 is conventionally carved from wood or made from plastic material. When mouthpiece frame 10 is of one piece construction, it is ordinarily made by using a lost wax casting or molding technique in the same manner as dentures are manufactured. When so made, the mouthpiece of the present invention can include secondary reed 42 as an integral part thereof, necessitating no separate mounting or attaching step in its fabrication. However, in a second embodiment of the invention shown in FIG. 5, secondary reed 46 has a bent mounting portion 48, which is attached to the inside surface of inclined wall 50. In this embodiment shown in FIG. 8, secondary reed 46 is made of brass, although other materials can also be used, such as wood, cane, plastic, or metals other than brass.

Although the invention has been described and illustrated with respect to a modification of a single reed mouthpiece, such as that in use with saxophones and clarinets of various types, the concept of the invention can be extended to modify a tone quality of double reed instruments, such as the oboe, bassoon and English horn. Materials of construction for mouthpiece frame 10 can vary, including the plastic illustrated in the drawings, but also encompassing metal, hard rubber, and the like. Moreover, primary reed 22 can be selected from a plurality of possible construction materials, including plastic, elastic wood, French cane, and the like.

Figure 5:
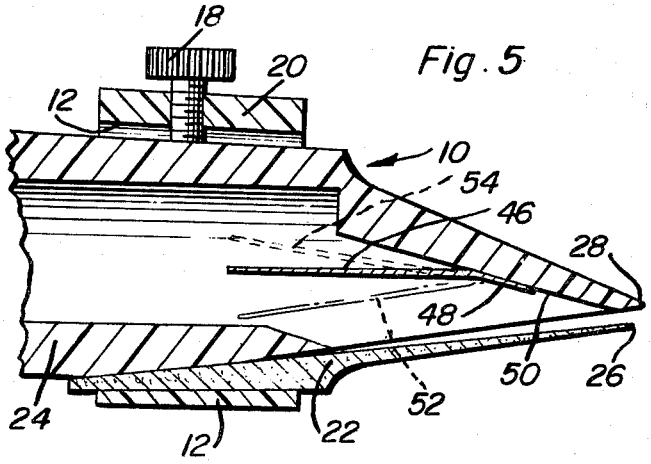
FIG. 5 is a fragmentary sectional view of the distal end of a second embodiment of the mouthpiece of the present invention, where the secondary reed is attached to the mouthpiece frame and can be bent toward or away from the location of the primary reed, as indicated in phantom.

The manner of mounting of the secondary reed can affect considerably the results obtained with the invention. For example, when secondary reed 46 shown in FIG. 5 is bent near base 48 to the position 52 shown in phantom, and secondary reed 46 then vibrates sympathetically from a position somewhat closer to primary reed 22, a louder and brighter tone is produced than when in the full line position. Conversely, bending secondary reed 46 near base 48 to the position designated by the numeral 54, where the secondary reed is arranged to vibrate sympathetically from a position away from primary reed 22, a darker sound is generated. Furthermore, it has been found advantageous to mount the secondary reed on the inside surface of inclined wall 50, rather than further back in tone chamber 38. When secondary reed 46 is not integral with mouthpiece frame 10, such as is illustrated in FIG. 5, base 48 is attached by a suitable adhesive, such as an epoxy cement. Other alternative equivalent methods of attachment, such as bolting, riveting, and the like, can be used, so long as a firm attachment is made and no substantial blockage or interference with the flow of air through tone chamber 38 results.

The foregoing is considered as illustrative only of the principles of the invention. Further, since numerous modification and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a mouthpiece for clarinet or saxophone wherein the mouthpiece comprises a hollow mouthpiece frame and a primary reed, the frame including an inclined wall opposed to the primary reed defining an interior elongated tone chamber having a longitudinal extent and an end for attachment to a length of tubular instrument body and having a chink opening between said primary reed and said mouthpiece for blowing of air therethrough to produce a musical tone, the improvement comprising a secondary reed mounted within said tone chamber for vibrating sympathetically to modify the tone so produced, the secondary reed being disposed substantially parallel to said longitudinal extent and being integral with said mouthpiece frame, said primary and secondary reeds having generally flat surfaces in substantially parallel relation to each other, said secondary reed having a mounting portion and a sympathetically vibrating portion, the mounting portion being secured to the inside surface of the inclined wall and the vibrating portion being directed substantially parallel to said longitudinal extent, said secondary reed being bendable along said vibrating portion near said mounting portion to permit bending closer to said primary reed about a transverse line generally parallel to the inner surface of the primary reed to produce a louder and brighter tone and bendable along said vibrating portion about the same transverse line near said mounting portion to permit bending away from said primary reed to produce a darker sound, whereby the vibratable primary reed creates an oscillatory motion of air within said tone chamber, which oscillatory motion of air sets the secondary reed into sympathetic vibration and causes the tone produced by the instrument to be modified.

2. The improvement of claim 1 wherein said mouthpiece frame and secondary reed are cast or molded plastic.

3. The improvement of claim 1 wherein said secondary reed is metal.

4. The improvement of claim 3 wherein said metal is brass.

* * * * *